US012345027B1

(12) United States Patent
Maciolek et al.

(10) Patent No.: US 12,345,027 B1
(45) Date of Patent: Jul. 1, 2025

(54) THERMALLY ACTIVATED WARMER

(71) Applicant: UIPCO, LLC, San Antonio, TX (US)

(72) Inventors: Michael J. Maciolek, Kerrville, TX (US); Manfred Amann, San Antonio, TX (US); Donnette L. Moncrief Brown, San Antonio, TX (US); Timothy Frank Davison, San Antonio, TX (US); Snehal Desai, Richardson, TX (US); Nicole Ferretti, Plano, TX (US); Rachel Michelle Ballew, San Antonio, TX (US); Kelsey Anne O'Brien, Austin, TX (US); Sayeef Rahim, Frisco, TX (US); Eric David Schroeder, San Antonio, TX (US); Steven J. Schroeder, Oak Point, TX (US); Joseph Michael Vesco, Sparks, NV (US); Justin Dax Haslam, San Antonio, TX (US); Melissa Jane Porter, San Antonio, TX (US)

(73) Assignee: United Services Automobile Association (USAA), San Antonio, TX (US)

( * ) Notice: Subject to any disclaimer, the term of this patent is extended or adjusted under 35 U.S.C. 154(b) by 112 days.

(21) Appl. No.: 18/344,074

(22) Filed: Jun. 29, 2023

Related U.S. Application Data

(60) Provisional application No. 63/356,642, filed on Jun. 29, 2022.

(51) Int. Cl.
*E03B 7/12* (2006.01)

(52) U.S. Cl.
CPC ..... *E03B 7/12* (2013.01)

(58) Field of Classification Search
CPC ..... E03B 7/10; E03B 7/12; E03B 7/14; E03B 9/027; F16L 53/00; F16L 53/30; F16L 59/02; Y10T 137/7036; Y10T 137/7043
See application file for complete search history.

(56) References Cited

U.S. PATENT DOCUMENTS

| | | | | |
|---|---|---|---|---|
| 2,985,552 | A * | 5/1961 | Watanabe | F16L 59/161 150/156 |
| 4,103,701 | A * | 8/1978 | Jeng | E03B 7/12 150/156 |
| 5,614,119 | A * | 3/1997 | Ollis | F16K 27/12 392/416 |
| 5,878,776 | A * | 3/1999 | Love | F16K 27/12 285/47 |
| 9,493,944 | B1 * | 11/2016 | Wesseler | A01G 13/26 |
| 11,193,604 | B2 * | 12/2021 | Wilson | F16K 27/08 |
| 2020/0378513 | A1 * | 12/2020 | Kowalski | F16K 27/12 |

* cited by examiner

*Primary Examiner* — Marina A Tietjen
(74) *Attorney, Agent, or Firm* — Plumsea Law Group, LLC

(57) ABSTRACT

A warming device is disclosed. The warming device includes an interior void that is sized to accommodate an exterior plumbing fixture, like an outside faucet. The warming device includes a heating member that is automatically activated in response to a change in temperature. When activated, the heating member generates heat to help protect the exterior plumbing fixture from the elements.

17 Claims, 6 Drawing Sheets

THERMALLY ACTIVATED WARMER

CROSS-REFERENCE TO RELATED APPLICATIONS

This application claims the benefit of U.S. Provisional Patent Application No. 63/356,642 filed Jun. 29, 2022, and titled "THERMALLY ACTIVATED WARMER," which is incorporated by reference herein in its entirety.

BACKGROUND

1. Field of the Disclosure

The present disclosure relates generally to a device to protect outdoor plumbing features from the elements. In particular, the disclosure relates to a warming device that activates automatically.

2. Description of Related Art

During winter, external plumbing fixtures like outdoor faucets may be damaged by prolonged periods of freezing temperatures. Water expands when it freezes and this phenomenon may damage plumbing fixtures that retain even small quantities of water throughout the winter months.

To prevent freezing, some homeowners periodically run water through the external plumbing fixtures in an attempt to prevent freezing. However, this is inconvenient and unless this is done frequently, may not prevent freezing and damage to the plumbing fixture.

There is a need in the art for a device that addresses the shortcomings of the related art discussed above.

SUMMARY OF THE DISCLOSURE

The disclosure is directed to a warming device for exterior plumbing features. The warming device may include features that automatically activate the warming device in response to temperature changes.

In one aspect, the invention provides a warming device that includes a first sidewall having a peripheral portion and a central portion, a second sidewall having a peripheral portion and a central portion; the first sidewall being attached to the second sidewall along their respective peripheral portions, thereby forming an interior void, a heating member having an exterior layer, the heating member being disposed in the first sidewall, the heating member including a thermal response device that is activated by a change in temperature, wherein the thermal response device introduces air into the heating member by forming a hole on the exterior layer of the heating member.

In another aspect, the invention provides a warming device including: first and second sidewalls forming an interior void; the interior void having an inner layer facing the interior void; he inner layer being generally gas impermeable; the inner layer including a heating member; the heating member having at least one chemical; the heating member including a thermal response device that is automatically activated by a change in temperature, wherein the thermal response device introduces air into the heating member by forming a hole on the inner layer; and the air causes the at least one chemical disposed in the heating member to react with the air producing a reaction that produces heat.

In another aspect, the invention provides a method of warming an exterior plumbing fixture using the following steps: installing a warming device over the exterior plumbing fixture; where the installing step including a step of moving the warming device over the exterior plumbing fixture so that the exterior plumbing fixture is housed inside an interior void of the warming device; activating a thermal response device by automatically changing a physical configuration of the thermal response device in response to a change in temperature; introducing air into a heating member by piercing a gas impermeable exterior layer of the heating member, thereby introducing air into an interior of the heating member; reacting at least one chemical disposed in the interior of the heating member with the introduced air, the reacting step causing a chemical reaction; where the chemical reaction generates heat in the heating member, and the interior void is heated; and warming the exterior plumbing fixture by heating the interior void.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the disclosure. Moreover, in the figures, like reference numerals designate corresponding parts throughout the different views.

DETAILED DESCRIPTION

Various embodiments provide an outdoor pipe warmer, and in particular, an outdoor pipe warmer that is thermally activated. Specifically, the various embodiments include features that automatically provide additional heat and warmth when the ambient outdoor air falls below a preselected temperature level.

Figure 1:
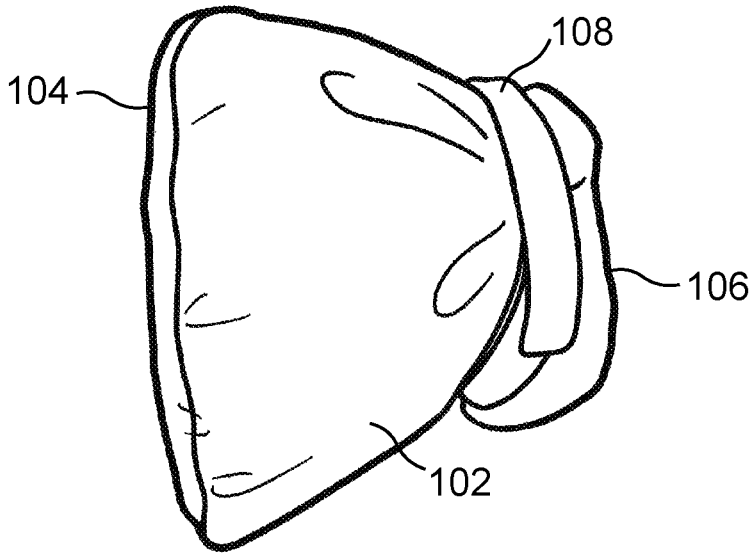
FIG. 1 is a schematic diagram of an embodiment of a warming device.

Referring to FIG. 1, warming device 100 is shown. Solely for purposes of illustration, is a schematic diagram of one possible version of warming device 100. In the embodiment shown in FIG. 1, the warming device may resemble a bag 100. Bag 100 may be configured to be any shape or size. Referring to FIG. 1, bag 100 shown in that Figure is generally rectangular. However, it should be kept in mind that the principles of the invention can apply to a bag having any shape or size.

Figure 2:
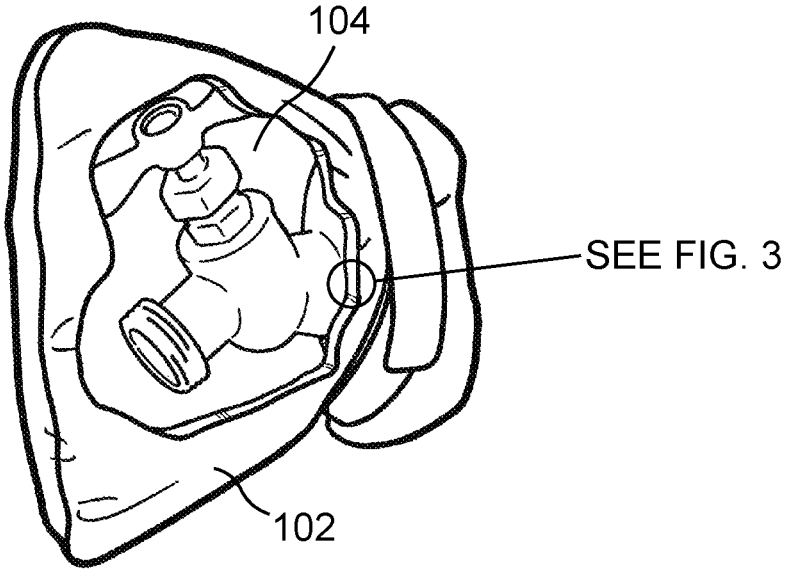
FIG. 2 is a schematic cutaway diagram of an embodiment of a warming device.

Bag 100 can include a perimeter with one or more edges. In the embodiment shown in FIG. 1, bag 100 may include two side walls that include a perimeter. The term "side wall" is used to generally describe the sides of the bag. It is not intended to imply that the sides of the bag are necessarily rigid. In contrast, embodiments of the bag are preferably constructed of generally flexible side walls. First side wall 102 is shown in FIG. 1, and opposite second side wall 104 can be seen in FIG. 2. As shown in FIG. 2, first side wall 102 is opposite second side wall 104. First side wall is preferably joined to second side wall 104 to form an interior pocket or void.

In some embodiments, the two side walls may be permanently joined on multiple edges. In this specification and claims, "permanently joined" means that the walls can only be separated by destructive separation of one or both walls, or the joint must be damaged or destroyed to separate the first wall from the second wall at that location. The two side walls of bag 100 may be permanently joined on three edges of the perimeter. The remaining fourth edge 106 may be open to accommodate a pipe, conduit or some kind of exterior plumbing fixture.

Bag 100 may include a closure device 108 proximate fourth edge 106. Closure device may include a strap or other cinching device that is capable of gathering and drawing together the material of first side wall 102 and second side wall 104. Without restraint, closure device 108 could substantially close fourth edge 106. However, in most embodiments, closure device 108 would cinch around a pipe (not shown) or a plumbing fixture.

In some embodiments, the arrangement of the perimeters can create an interior void 200 of warming device 100, as shown in FIG. 2. This allows warming device 100 to accommodate an outdoor plumbing fixture. A user could move warming device 100 over the outdoor plumbing fixture so that warming device 100 substantially encases and surrounds the outdoor plumbing fixture, as shown in FIG. 2.

Figure 3:
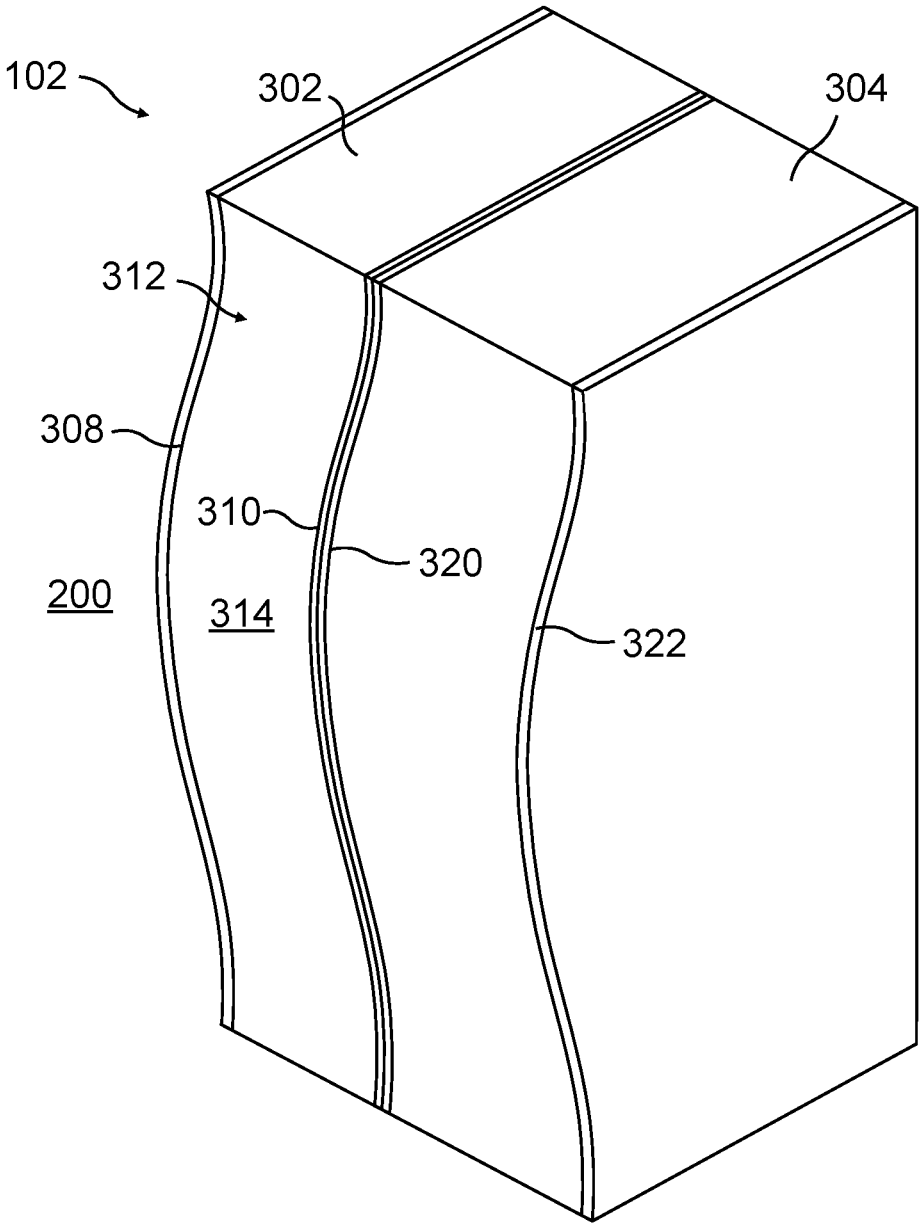
FIG. 3 is an enlarged diagram of an embodiment of a side wall.

Warming device 100 is generally used to protect outdoor plumbing features from excessive cold temperatures. Some embodiments of warming device 100 may include multiple optional layers. FIG. 3 is an enlarged view of a portion of first side wall 102. In the embodiment shown in FIG. 3, first side wall 102 includes two optional members. A heating member 302 and an insulating member 304. Insulating member 304 is optional, and may be omitted in some embodiments. In the embodiment shown in FIG. 3, heating member 302 is disposed interior of insulating member 304. In other words, heating member 302 is disposed closer to interior void 200 than insulating member 304. Heating member 302 includes an inner layer 308 that faces interior void 200, and an opposite outer layer 310 that is disposed further away from interior void 200 than inner layer 308. The inner layer 308 and outer layer 310 of heating member 302 create a heating void 312 between the two respective layers. Heating void 312 may be filled with a heating material, discussed in greater detail below.

Optional insulating member 304 includes an inner surface 320 and an outer surface 322. In the embodiment shown in FIG. 3, the inner surface 320 of insulating member 304 confronts the outer layer 310 of heating member 302. In some embodiments, the inner surface 320 of insulating member 304 may be joined or attached to the outer layer 310 of heating member 302. In other embodiments, the heating member 302 is not attached to insulating member 304, but rather is sized and configured to nest within insulating member 304. In other words, in those embodiments where the heating member 302 is not attached to insulating member 304, the exterior size of heating member 302 may correspond with the interior cavity of insulating member 304, allowing heating member 302 to fit within insulating member 304.

In those embodiments where both heating member 302 and insulating member 304 are provided, warming device 100 may be able to retain enough heat within interior void 100 to protect the exterior plumbing feature from freezing under certain conditions. However, as the ambient temperature drops, the passive insulating properties of warming device 100 may become insufficient so that the interior temperature of interior void 200 drops below freezing for an extended period of time. Under these circumstances, embodiments of the present invention may provide an active heating feature.

Referring to FIG. 3, the inner layer 308 and outer layer 310 of heating member 302 may create a heating void 312 between the two respective layers. In some embodiments, heating void 312 may be filled with a heating material 320. This heating material 320 may be selectively activated. in other words, heating material 320 may maintain a status quo state until heating material 320 is disturbed or activated in some way. In some embodiments, the introduction of a chemical or gas may activate heating material 320. In some embodiments, this activation of heating material 320 may cause heating material 320 to undergo a reaction of some kind. In some cases, heating material 320 may undergo an exothermic reaction or process when a chemical is introduced into heating void 312. An exothermic reaction or process is one where heating material 320 releases some form of energy: heat, light, electricity, or sound to its surroundings. In a preferred embodiment, the constituent compounds of heating material 320 are selected so that the exothermic process or reaction releases heat to its surroundings.

In one embodiment, heating material 320 includes the following constituent materials: iron, activated carbon, vermiculite, salt and optionally cellulose. These materials are selected to produce an oxidation of iron when exposed to ambient air. The iron may be selected as the oxidizing material. Vermiculite may serve as a water reservoir. Salt may be included as a catalyst. Activated carbon may be selected to evenly distribute heat. And finally, cellulose may be provided to add bulk or thickness to heating material 320. In some embodiments, sawdust or similar material may be used in conjunction with cellulose or it may replace cellulose.

Preferably, heating void 312 provides an air tight package created by inner layer 308 and outer layer 310 of heating member 302. This air tight package allows heating material 320 to be contained within heating void 312 in an undisturbed condition.

Some embodiments include provisions for introducing ambient air, which includes oxygen, into heating void 312. In some cases, a thermal response device that responds to temperature may be selected. This thermal response device may include provisions that allow the device to automatically respond to changes in temperature without manual control or intervention. In some cases, the thermal response device acts automatically without the need for sensors, power, or any other kind of control system. Some embodiments include a component made of bimetallic materials. By attaching dissimilar metals, that have different coefficients of thermal expansion, to one another, the bimetallic component is able to respond to changes in temperature with mechanical movement or displacement.

An embodiment of a thermal response device is shown in FIGS. 4-7. Referring to FIGS. 4-7, thermal response device 400 may be made of a material that mechanically responds to temperature changes. In the embodiment shown in FIGS. 4-7, thermal response device 400 may be formed into a shape that accentuates the temperature response characteristics of the device. In one embodiment, thermal response device 400 is formed with a generally hemispherical shape.

As shown in FIGS. 4-7, one embodiment of thermal response device 400 may include a curved portion 402 and a rim 404. The curved portion 402 may be any suitable curve, both simple and complex curves are possible. Curved portion 402 may resemble a hemisphere, a partial sphere, and have a generally constant radius throughout the curved portion 402. However, other embodiments have a curved portion where the curvature tapers as the curved portion extends to the periphery. In these embodiments, curved portion 402 may have more curvature towards the central portion 406 of curved portion 402 than a periphery 408 of curved portion 402. In mathematical terms, the curvature (expressed as the inverse of the radius of curvature) would be greater in the central portion 406 than the periphery 408 of curved portion 402.

The overall structure and design of thermal response device 400 may be used to accentuate the mechanical displacement when thermal response device 400 experiences a temperature change. In the embodiment shown in FIGS. 4-7, thermal response device 400 may be made of two dissimilar materials. As shown in FIG. 5, which includes an enlarged cross-sectional view of thermal response device 400, thermal response device 400 may include a first layer 406 and a second layer 408. First layer 406 may be made of a material that includes metal. Likewise, second layer 408 may also be made of a material that includes metal. In some cases, first layer 406 may be made of a metal that has a first coefficient of thermal expansion, and second layer 408 may be made of a metal that has a second coefficient of thermal expansion.

To assist with the mechanical displacement, first layer 406 may be attached or bonded to second layer 408. Any suitable means of attaching first layer 406 to second layer 408 may be used. In some cases, the layers are welded together, in other cases, the two layers are joined with an adhesive.

In some embodiments, the materials for the first and second layers maybe be selected to enhance the mechanical displacement of thermal response device 400 when the device is cooled. In the embodiment shown in FIGS. 4-7, the material for first layer 406 may be selected so that first layer 406 is less thermally responsive than second layer 408. In other words, first layer 406 may have a lower coefficient of thermal expansion than second layer 408. Conceptually, this means that when the two layers, first layer 406 and second layer 408, are cooled, second layer 408 will contract faster than first layer 406.

Figure 4:
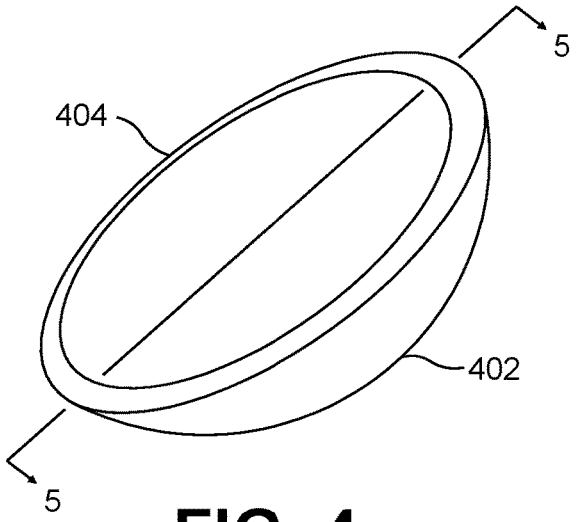
FIG. 4 is a schematic diagram of an embodiment of a thermal response device in a first configuration.
Figure 5:
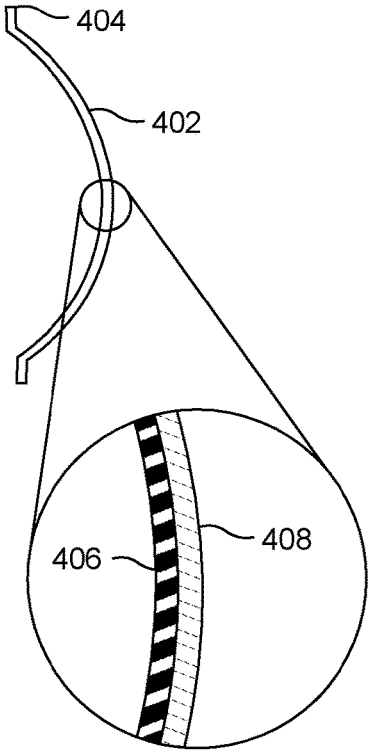
FIG. 5 is a schematic diagram of a cross-section of the thermal response device shown in FIG. 4, according to an embodiment.

Operation of this mechanical displacement during a temperature change can be observed in FIGS. 4-7. Thermal response device 400 has an initial condition as shown in FIGS. 4 and 5. In this initial condition, curved portion 402 can be seen as concave with first layer 406 being disposed radially inward of second layer 408. Second layer 408 can also be seen forming an outer shell around inner layer 406. As thermal response device 400 is cooled, second layer 408 will contract or shrink in size faster than first layer 406. This is because first layer 406 may have a lower coefficient of thermal expansion than second layer 408. As second layer 408 continues to contract under falling temperatures, it tends to straighten out the curved portion 402. It should also be noted that during this time, first layer 406 is resisting contraction. These two layers working cooperatively can function to flatten out curved portion 402.

Figure 6:
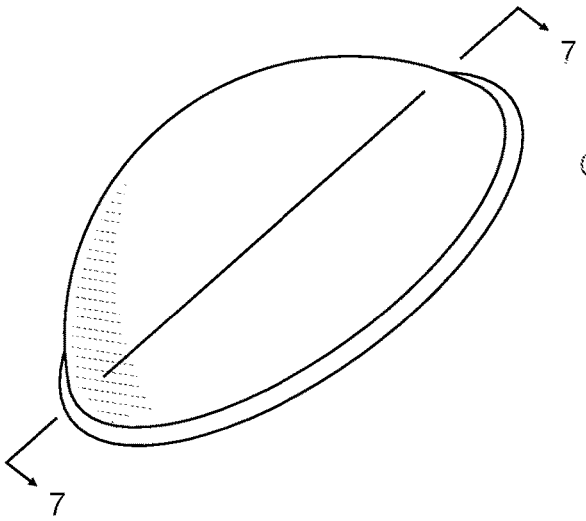
FIG. 6 is a schematic diagram of an embodiment of a thermal response device in a second configuration.
Figure 7:
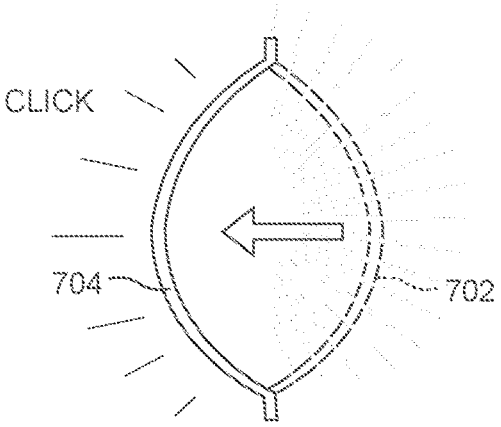
FIG. 7 is a schematic diagram of a cross-section of the thermal response device shown in FIG. 6, according to an embodiment.

Eventually, thermal response device 400 achieves a condition where it is unable to sustain its initial concave shape. At this point, thermal response device 400 will rapidly invert from a concave shape, as shown in FIGS. 4 and 5 to a convex shape, as shown in FIGS. 6 and 7. In FIG. 7, the initial concave condition is shown in phantom as 702 and the convex shape after cooling is shown as 704. In some cases, the rapid inversion of thermal response device 400 may be accompanied by an audible noise or "click." The operation of thermal response device 400 may be considered similar to the operation of an eye popper or hopper popper. See Davis, U.S. Pat. No. 2,153,957, the entirely of which is hereby incorporated by reference for all purposes.

Some embodiments include optional provisions to further enhance the thermal response characteristics of thermal response device 400. In these embodiments, residual stresses may be applied to thermal response device 400. In one embodiment, thermal response device 400 is created with a spring bias to achieve the convex position shown as 704. From this convex position 704, thermal response device 400 is deflected against the spring bias to achieve its initial condition 702.

When thermal response device 400 is in initial condition 702, residual stress from the initial deflection creates a bias where thermal response device 400 wants to invert to achieve its convex rest position 704. However, the initial deflection has placed thermal response device 400 in an inverted rest position that includes residual stress. The bimetallic layers maybe used to either enhance the spring bias or counteract the spring bias.

In those embodiments where the bimetallic layers are used to enhance the spring bias, the bimetallic layers are arranged so that the residual stress created by the arrangement of the bimetallic layers matches the spring bias imparted onto thermal response device 400. In other words, both the residual stress created by the arrangement of the bimetallic layers and the residual stress created by inverting thermal response device 400 tend to bias the thermal response device 400 to return to its convex rest position 704.

In those embodiments where the bimetallic layers are used to counteract the initial spring bias, the bimetallic layers are arranged so that the residual stress created by the arrangement of the bimetallic layers acts opposite the spring bias imparted onto thermal response device 400 when thermal response device 400 is inverted. In other words, the residual stress created by the arrangement of the bimetallic layers tends to act opposite the residual stress created by inverting thermal response device 400. In this configuration, the residual stress created by the bimetallic layers tends to keep the thermal response device 400 in the deflected inverted position, the initial condition shown as 702.

Figure 8:
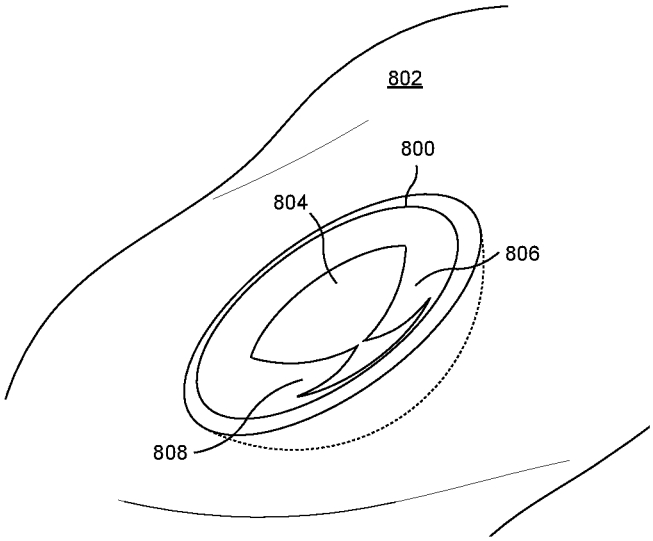
FIG. 8 is a schematic diagram of an embodiment of a thermal response device with an associated sheet in a first configuration.
Figure 9:
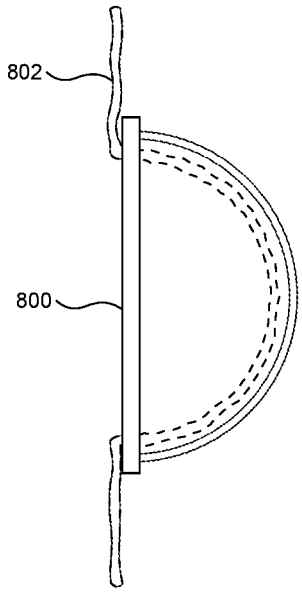
FIG. 9 is a schematic diagram of a cross-section of the thermal response device with an associated sheet shown in FIG. 8, according to an embodiment.

In some embodiments, the thermal response device cooperates with a sheet of material. In some cases, the various components are arranged so that the thermal response device tears or punctures the sheet. Referring to FIGS. 8 and 9, which show an initial condition prior to thermal activation, thermal response device 800 may cooperate with sheet 802. Sheet 802 may be any suitable non-brittle material that can conform, drape or bend. Generally, sheet 802 may behave like a fabric or a sheet of plastic wrap. In the embodiment shown in FIGS. 8-11, sheet 802 is like a sheet of plastic wrap. In some embodiments, like the one shown in FIGS. 8-11, sheet 802 may be gas impermeable.

Layer 802 may conform with the general shape of thermal response device 800. In some embodiments, layer 802 may be joined in some way to thermal response device 800. In the embodiment shown in FIGS. 8-11, layer 802 is attached to thermal response device 800 using a light adhesive. This adhesive preferably does not interfere with the operation of thermal response device 800 but rather, acts to merely join layer 802 to thermal response device 800.

Thermal response device 800 may optionally include provisions to that can assist in tearing or puncturing sheet 802. In some cases, the general dome shape of thermal response device 800 may include a discontinuity or irregularity. In some cases, this discontinuity may include a hole or aperture in thermal response device 800. In some embodiments, this hole may include features that present an edge or point when thermal response device 800 changes shape.

In the embodiment shown in FIGS. 8-11, thermal response device 800 includes a hole 804. Hole 804 includes one or more projections. In the embodiment shown in FIG. 8, two projections, a first projection 806 and a second projection 808 are provided. It should be noted that some embodiments may include a single projection, while other embodiments may include more than two projections. Two projections are shown to clearly illustrate the operation of an exemplary discontinuity. However, it should be kept in mind that any suitable number of projections or discontinuities may be provided for any particular application.

FIGS. 8 and 9 show thermal response device 800 with its cooperating sheet 802 in an initial condition, prior to thermal activation. In this condition, thermal response device 802 is generally concave when viewed from above, like in FIG. 8. Hole 804 is formed into the dome like shape of thermal response device 800, and projections 806 and 808 generally conform with the dome-like shape of thermal response device 800. Note that in FIG. 9, which is a cross-sectional view, projections 806 and 808 correspond with the dome-like shape of thermal response device 800. In this initial shape, projections 806 and 808 match the gentle curve of thermal response device 800 and the projections 806 and 808 do not present a sharp edge or point to sheet 802. This helps to prevent premature tearing of sheet 802.

Figure 10:
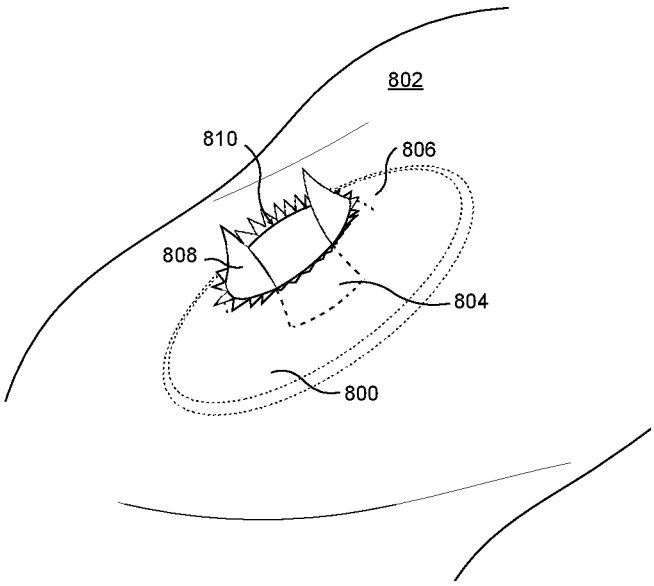
FIG. 10 is a schematic diagram of an embodiment of a thermal response device with an associated sheet in a second configuration.
Figure 11:
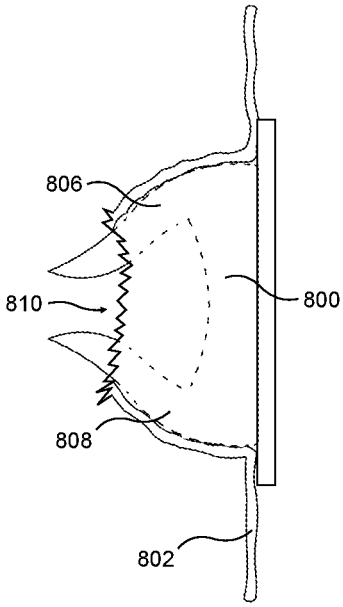
FIG. 11 is a schematic diagram of a cross-section of the thermal response device with an associated sheet shown in FIG. 10, according to an embodiment.

FIGS. 10 and 11 show thermal response device 800 and cooperating sheet 802 after thermal response device 800 has been thermally activated. As disclosed above, thermal response device 800 has experienced a temperature change between the initial condition shown in FIGS. 8 and 9 and the thermally activated condition shown in FIGS. 10 and 11. As shown in FIGS. 10 and 11, the temperature change has thermally activated thermal response device 800 and thermal response device 800 has inverted from its initial condition.

As shown in FIG. 10, thermal response device 800 when viewed from above, has now inverted and has achieved a convex shape. This inversion has also caused first projection 806 and second projection 808 to also invert. Because of hole 804 and the irregular shape of first projection 806 and second projection 808, these projections present a sharp edge or point sheet 802. The projections 806 and 808 can enhance the ability of thermal response device 800 to tear or puncture sheet 802 during thermal activation when thermal response device 800 inverts. In some cases, projections 806 and 808 can be designed so that their inverted, thermally activated shapes are different than the inverted shape of an unmodified thermal response member 800 that omits a hole and projections. As shown in FIGS. 10 and 11, sheet 802 has been punctured by thermal response device 800 during inversion. In the particular embodiment shown in FIGS. 10 and 11, first projection 806 and second projection 808 have created puncture hole 810 in sheet 802.

Some embodiments may include an optional adhesive that acts to join sheet 802 to thermal response device 800. This adhesive can help to ensure that sheet 802 remains attached to thermal response device 800 during thermal activation or inversion. In some cases, where an adhesive is omitted, inversion of thermal response device 800 may fail to puncture sheet 802, but rather push sheet 802 away from thermal response device 800. Use of an adhesive may help to prevent this kind of inversion that fails to puncture or tear sheet 802.

Figure 12:
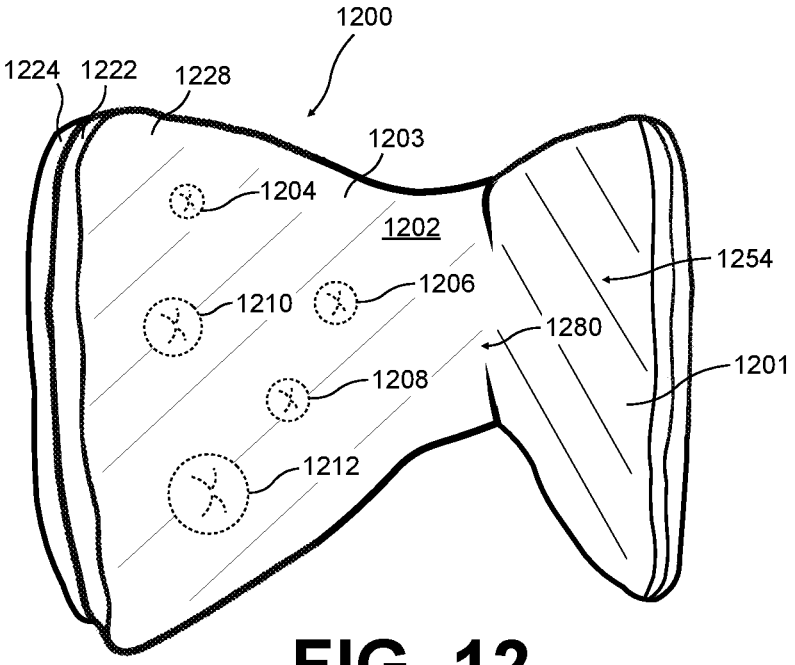
FIG. 12 is an exposed schematic diagram of a warming device in a first configuration, according to an embodiment.

This arrangement of a thermal response device in cooperation with a sheet may be applied to a warming device. FIG. 12 is an exposed schematic diagram of the interior void 1280 of warming device 1200. This Figure exposes the interior void 1280 of warming device 1200 by peeling apart first side wall 1201 away from second side wall 1203. As disclosed above and with reference to FIG. 3, warming device 1200 may include a heating member 1222. Heating member 1222 may have an inner surface 1228 that is exposed to the interior void 1280 of warming device 1200.

In the embodiment shown in FIG. 12, one or more thermal response devices may be associated or attached to inner surface 1228 of heating member 1222. If more than one thermal response device is provided, those thermal response devices may be of a similar size, or they may be dissimilar in size with one being larger than the other. Also, the location and distribution of the thermal response devices may vary and may be selected based on desired attributes.

FIG. 12 shows one example distribution of a plurality of thermal response devices. In the exemplary embodiment, thermal response devices of various sizes are shown, however, it should be kept in mind, that other embodiments may include thermal response devices having substantially the same size. In the embodiment shown in FIG. 12, warming device 1200 includes a first thermal response device 1204, a second thermal response device 1206 and a third thermal response device 1208. All three of these thermal response devices are substantially the same size and are distributed in different locations throughout the inner surface 1228 of heating member 1222. In the embodiment shown in FIG. 12, first thermal response device 1204 is disposed above second thermal response device 1206. First thermal response device 1204 is also disposed distal to second thermal response device 1206. Third thermal response device 1208 is disposed below second thermal response device 1206, and in between first thermal response device 1204 and third thermal response device 1206 in the lateral (distal-proximal) direction.

The locations of the various thermal response devices may be selected based on where it is desirable for air to enter heating member 1222. The introduction of air into heating member 1222 determines the initial location of the chemical reaction. An even distribution of air intakes via the various thermal response devices may produce an even, distributed chemical reaction that would help to evenly heat heating member 1222. In other embodiments, the air intakes are not evenly distributed so that the progression of the chemical reaction may be controlled, or in some cases, slowed.

Some embodiments may include thermal response devices if different sizes. One example is shown in FIG. 12. In that example, warming device 1200 includes a fourth thermal response device 1210. This fourth thermal response device may be larger than the first, second and third thermal response devices. Fourth thermal response device may be located in any desired location. In the embodiment shown in FIG. 12, fourth thermal response device 1210 is located slightly distal to first thermal response device 1204, and also below first thermal response device 1204. The use of fourth thermal response device 1210 is optional and some embodiments omit a larger thermal response device.

Some embodiments may also include an optional thermal response device that is even larger than fourth thermal response device 1210. FIG. 12 is an example of an embodiment that includes a thermal response device that is larger than fourth thermal response device 1210. In the embodiment shown in FIG. 12, fifth thermal response device 1212 is included. This fifth thermal response device 1212 is larger than fourth thermal response device 1210, and is the largest thermal response device of the warming device 1200 example shown in FIG. 12. In the embodiment shown in FIG. 12, fifth thermal response device 1212 is disposed slightly less distal than fourth thermal response device 1210 and below fourth thermal response device 1210. However, fifth thermal response device 1212 is purely optional, and may also be placed in any desired location on heating member 1222.

Inner surface 1228 may also include a sheet 1202. Sheet 1202 may cooperate with thermal response device or devices in a manner similar to sheet 802 shown in FIGS. 8-11. In some embodiments, sheet 1202 forms inner surface 1228, while in other embodiments, sheet 1202 may be one of a plurality of layers that form inner surface 1228.

In operation, warming device 100 may be placed over an exterior plumbing fixture as shown in FIGS. 1 and 2. As the temperature drops, warming device 100 may initially help to retain warm air just by virtue of providing insulation to the ambient air inside warming device 100. As the temperature continues to drop, in some cases, below freezing or some predetermined level below freezing, the insulation effect may become inadequate. At this point, one or more thermal response devices may be activated and operate in cooperation with an associated sheet, as shown in FIGS. 8-11. In the embodiment shown in FIGS. 12 and 13, sheet 1202 would cooperate with one or more thermal response devices.

The activation of each thermal response device may be controlled by a number of factors: the overall thickness of the device, particularly, of the metallic components; the relative thickness and disposition of the two metal layers that form the bimetallic portion of the device; the induced residual stresses applied to the device; the size of the device; the shape and number of projections formed into the device; and the thickness and resiliency of the associated sheet. By using these various factors, the activation temperature may be controlled or predetermined. For example, a smaller device may activate at a warmer temperature than a larger device, which would require a lower temperature to activate. However, two devices may be the same size, but one of them may activate at a lower temperature because it is made of thicker metal. Other ways to fine tune the factors mentioned above to achieve the desired activation temperature and performance would be apparent to the average artisan.

Figure 13:
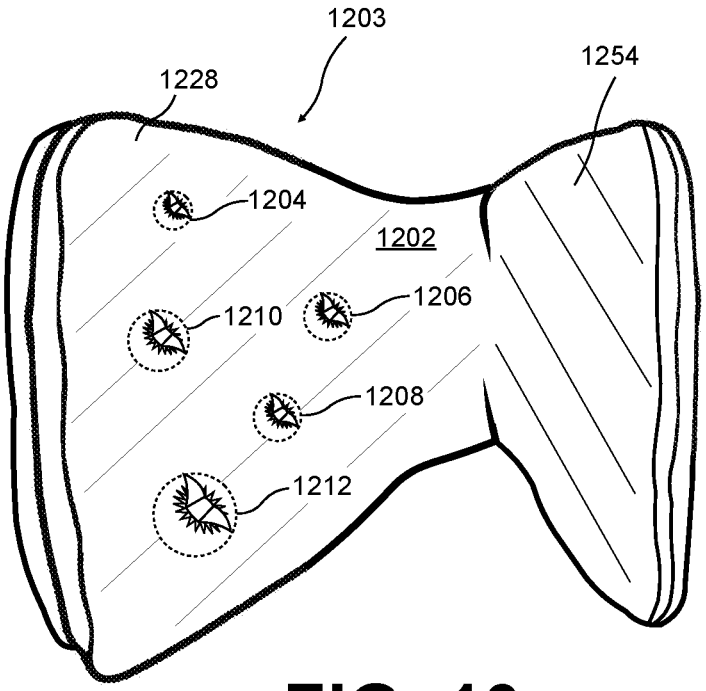
FIG. 13 is an exposed schematic diagram of a warming device in a second configuration, according to an embodiment.

During activation, the thermal response devices would be activated and would invert as shown in FIG. 13. Details of the inversion and its effect on an associated sheet can be seen in FIGS. 8-11. As they invert, the thermal response devices would tear or puncture sheet 1202. This puncture would introduce air into the interior of heating member 1222. In other words, the activation of at least one thermal response device would place the ambient air inside the internal void in fluid communication with the heating material. Heating member 1222 is analogous with heating member 302 in FIG. 3. Recall that heating member 302 includes a heating void 312 that is filled with a heating material 314 that is activated by air.

When air interacts with heating material 314, heating material 314 generates heat that is produced when air reacts with the chemicals of heating material 314. In the embodiment shown in FIGS. 12 and 13, these chemicals of the heating material produce an endothermic reaction when exposed to air. This reaction is discussed in greater detail above.

It should be noted that, for clarity, only one wall of warming device 100 is shown in FIGS. 12 and 13. Similar features may optionally be provided on the opposite wall of warming device 100 so that both opposing walls include a thermally responsive warming device. However, some embodiments only include this feature on one side wall.

Figure 14:
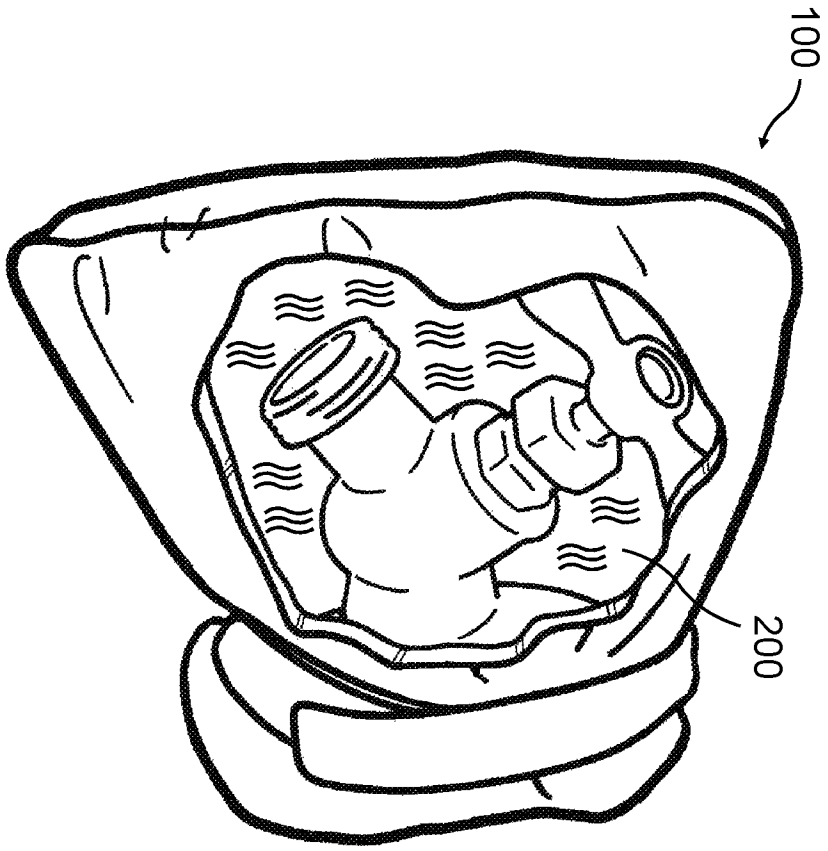
FIG. 14 is a schematic cutaway diagram of an embodiment of a warming device in use.

The heat generated by heating material 314 warms the interior void 200 of warming device 100 as shown schematically in FIG. 14. This can help prevent exterior plumbing fixtures from freezing. Water expands when it freezes, and small amounts of water left inside exterior plumbing fixtures can damage those fixtures to a point where the damage causes leaks. By preventing the exterior plumbing fixtures from freezing, damage to those fixtures can be avoided.

After heating member 1222 has been used and is no longer capable of generating sufficient heat, some embodiments optionally provide for easy replacement of heating member 1222. In some embodiments, heating member 1222 may be detachable and replaceable. In these embodiments, heating member 1222 may be attached to warming device 100 in a way that allows for a used heating member 1222 to be easily removed. In some cases, a non-destructive fastener, such as a hook-and-loop fastener may be used to temporarily attach heating member 1222. In these embodiments, heating members may be quickly and easily replaced after use. Heating members may also be sold separately as a user replaceable component.

While various embodiments of the disclosure have been described, the description is intended to be exemplary, rather than limiting and it will be apparent to those of ordinary skill in the art that many more embodiments and implementations are possible that are within the scope of the disclosure. Accordingly, the disclosure is not to be restricted except in light of the attached claims and their equivalents. Also, various modifications and changes may be made within the scope of the attached claims.

We claim:

1. A warming device comprising:

a first sidewall having a peripheral portion and a central portion;

a second sidewall having a peripheral portion and a central portion;

the first sidewall being attached to the second sidewall along their respective peripheral portions, thereby forming an interior void;

a heating member having an exterior layer, the heating member being disposed in the first sidewall;

the heating member including a thermal response device that is activated by a change in temperature, wherein the thermal response device introduces air into the heating member by forming a hole on the exterior layer of the heating member.

2. The warming device according to claim 1, wherein the heating member includes an inner layer that faces the interior void of the warming device, and wherein the thermal response device is disposed on the inner layer of the heating member.

3. The warming device according to claim 1, wherein the thermal response device transitions from an initial concave position to a second convex position during activation in response to the change in temperature.

4. The warming device according to claim 1, wherein the thermal response device includes at least one projection configured to pierce the exterior layer of the heating member.

5. The warming device according to claim 1, including an insulating member, the insulating member being disposed outward of the heating member.

6. The warming device according to claim 1, wherein the interior void of the warming device is sized and configured to accommodate an outdoor faucet.

7. A warming device comprising:

first and second sidewalls forming an interior void;

the interior void having an inner layer facing the interior void;

the inner layer being generally gas impermeable;

the inner layer including a heating member;

the heating member having at least one chemical;

the heating member including a thermal response device that is automatically activated by a change in temperature, wherein the thermal response device introduces air into the heating member by forming a hole on the inner layer; and wherein the air causes the at least one chemical disposed in the heating member to react with the air producing a reaction that produces heat.

8. The warming device according to claim 7, wherein the at least one chemical includes iron (Fe), and wherein the reaction includes the oxidation of iron.

9. The warming device according to claim 7, wherein the activation of thermal response device includes a transition from an initial concave position to a second convex position during activation in response to the change in temperature.

10. The warming device according to claim 7, wherein the thermal response device includes at least one projection configured to pierce the inner layer of the heating member, thereby placing an interior of the heating member in fluid communication with ambient air inside the interior void.

11. The warming device according to claim 7, including an insulating member, the insulating member being disposed outward of the heating member.

12. The warming device according to claim 7, comprising a second thermal response device, wherein the second thermal response device is a different size than the first thermal response device.

13. A warming device comprising:

first and second sidewalls forming an interior void;

the interior void having an inner layer facing the interior void;

the inner layer being generally gas impermeable;

the inner layer including a heating member;

the heating member having at least one chemical;

the heating member including a thermal response device that is automatically activated by a change in temperature, wherein the thermal response device introduces air into the heating member by forming a hole on the inner layer;

wherein the air causes the at least one chemical disposed in the heating member to react with the air producing a reaction that produces heat;

wherein the activation of the thermal response device includes the thermal response device transitioning from an initial concave position to a second convex position during activation in response to the change in temperature; and wherein the thermal response device includes at least one projection configured to pierce the inner layer of the heating member, thereby placing an interior of the heating member in fluid communication with ambient air inside the interior void.

14. The warming device of claim 13, wherein the warming device further includes an insulating member, the insulating member being disposed outward of the heating member.

15. The warming device of claim 13, further comprising a second thermal response device, wherein the second thermal response device is a different size than the first thermal response device.

16. The warming device of claim 13, wherein the thermal response device includes projections that puncture the hole on the inner layer when the thermal response device transitions from the initial concave position to the second convex position.

17. The warming device of claim 13, wherein the thermal response device includes a first layer having a first coefficient of thermal expansion and a second layer having a second coefficient of thermal expansion.

* * * * *